US005117853A

United States Patent [19]

Pruesner

[11] Patent Number: 5,117,853

[45] Date of Patent: Jun. 2, 1992

[54] PORTABLE SHADE STRUCTURES EMPLOYING NON-SNAG HOOKS

[75] Inventor: Martin E. Pruesner, New Haven, Mo.

[73] Assignee: Gale Group, Inc., Winter Park, Fla.

[21] Appl. No.: 550,735

[22] Filed: Jul. 9, 1990

[51] Int. Cl.[5] ..... E04H 15/44

[52] U.S. Cl. ..... 135/106; 135/119; 135/907; 24/698.3

[58] Field of Search ..... 135/102, 106, 109, 119, 135/115, 907, 900, 118; 24/698.3, 698.1

[56] References Cited

U.S. PATENT DOCUMENTS

| | | | |
|---|---|---|---|
| 797,007 | 8/1905 | Lott | 24/698.3 X |
| 935,098 | 9/1909 | Ferris | 24/698.3 X |
| 1,662,262 | 3/1928 | Gates | 24/698.3 |
| 2,788,011 | 4/1957 | Turner | 135/106 |
| 3,874,396 | 4/1975 | Kirkham | 135/119 X |
| 4,174,552 | 11/1979 | Franklin | 24/698.3 X |
| 4,793,371 | 12/1988 | O'Ferrell et al. | 135/119 X |
| 4,941,500 | 7/1990 | Emard | 135/119 X |
| 4,948,289 | 8/1990 | Dellinger | 135/106 X |

FOREIGN PATENT DOCUMENTS

| | | | |
|---|---|---|---|
| 0287424 | 4/1953 | Switzerland | 135/119 |
| 86/4383 | 2/1987 | U.S.S.R. . | |

*Primary Examiner*—David A. Scherbel
*Assistant Examiner*—Lan Mai
*Attorney, Agent, or Firm*—Allen, Dwyer, Doppelt, Franjola & Milbrath

[57] ABSTRACT

A portable shade structure includes a structural framework with space supports, and hook-receiving holes along some of the supports. A removable fabric cover fits across the structural framework, and has plural hooks attached at spaced locations dimensioned to removably fit into the hook-receiving holes of the support. Each hook has a curved return which permits the hook to be engaged within a corresponding hole, but which provides a smooth surface that reduces snagging when the hook is moved across, or is stored against the fabric cover.

12 Claims, 2 Drawing Sheets

PORTABLE SHADE STRUCTURES EMPLOYING NON-SNAG HOOKS

BACKGROUND OF THE INVENTION

The present invention relates to portable shade structures, and particularly relates to portable shade structures which employ hooks for attaching the fabric shade cover to a structural frame work with the hooks being provided for means for avoiding snagging of the hook on the fabric shade cover.

There is a class of portable shade structures sold under the trademarks PORTASHADE, GAZEBO and PAVILION by the Gale Group, Inc. of Apopka, Fla., who is the assignee of the present invention. The construction of these portable shade structures are characterized by a structural framework which is easily broken down into a number of parts, the framework including a plurality of spaced vertical supports. Each vertical support includes a hook-receiving hole along the vertical support. The shade structure includes a removable fabric cover dimensioned to fit across the structural framework, and includes a plurality of hooks attached at spaced locations to the fabric cover, each hook dimensioned to removably fit into one of the hook-receiving holes of the vertical supports. In use, the hooks are employed to enable the fabric cover to be stretched across the structural support in a facile manner.

After use, the shade structure is then broken down for transporting by removing the fabric cover and then folding it up into a compact bundle, and the structural framework is then broken down.

One of the problems that has developed in the past with respect to this type of portable shade structure relates to the hooks attached to the fabric cover. When wrapped into a compact bundle, or during the installation or removal of the fabric cover, oftentimes the hooks snag into and damage the fabric cover. It is therefore an important feature of the present invention for the provision of a non-snagging hook useful for such portable shade structures.

Prior art patents of interest with respect to portable shade structures of this type include U.S. Pat. No. 4,793,371 to O'Ferrell et al, and South African Patent 86/4383 to Vosse.

SUMMARY OF THE INVENTION

The present invention contemplates a portable shade structure having a structural framework including a plurality of spaced supports, with hook-receiving holes along the supports. The structure is provided with a removable flexible cover dimensioned to fit across and supported by the structural framework, with plural hooks attached at spaced locations to the flexible cover, each hook dimensioned to removably fit into one of the hook-receiving holes of the spaced supports. Means are provided along each hook for preventing snagging of the hook on the flexible cover. To this end and in accordance with the preferred form of the invention, the non-snagging means comprises a generally "S" shaped return curved portion of each hook. It is also preferred that the hook be formed with a continuous length of bent stock having two generally parallel legs, each leg having the generally "S" shaped return curve, and the legs spaced apart by common bridging portion which is generally normal to both legs and attached to the fabric cover.

In a specific form, each hook comprises an elongated member having a first shank portion attached at one end to the fabric cover, the first shank portion lying generally parallel to the adjacent support when the hook is fitted in the corresponding hole, and first and second return curves at the end of the first shank opposite the one end, the first and second return curves defining the "S" shaped configuration. The elongated member further includes a second shank portion extending from the second return curve. The lateral dimension across the "S" shaped return curves, i.e., between the first and second curves, is less than the dimension of the corresponding hook-receiving hole in the structural support into which the hook is to extend.

THE DRAWINGS

DETAILED DESCRIPTION

A preferred embodiment of the present invention will now be described with reference to the drawings.

Figure 1:
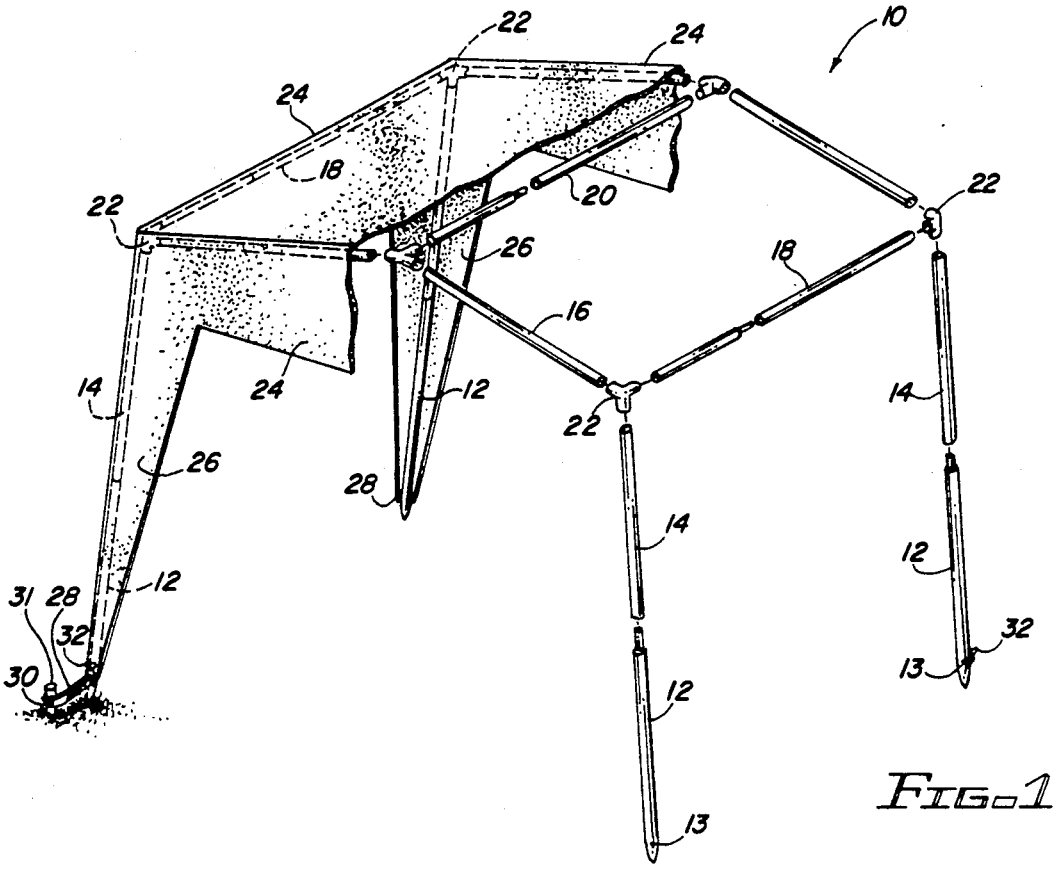
FIG. 1 is a perspective view, partially exploded and cut away, illustrating a portable shade structure of the type useful with the present invention.

FIG. 1 illustrates a portable shade structure, referred to generally by the reference numeral 10, which includes a structural framework including joined vertical support sections 12, 14. A hook-receiving hole 13 is positioned at the bottom of each vertical support section 12; however, it will be understood that the hook-receiving hole may be located anywhere along the support structure.

Other structural framework elements include horizontal frame members 16, 18, 20 and corners 22.

The portable shade structure 10 further includes a fabric cover 24, a portion of which is cut away in FIG. 1. The fabric cover 24 includes leg portions 26 which extend downwardly across the corresponding vertical supports 12, 14 and are attached at the bottom via a hook 32 into the hook-receiving hole 13; one of the hooks 32 is shown on the far lower right portion of the structural support 12 in FIG. 1. Conventionally, the end portion 28 of the fabric leg 26 has a fabric loop 30 into which a stake 31 is extended in order to fasten the portable shade structure 10 to the ground, against movement.

Figure 2:
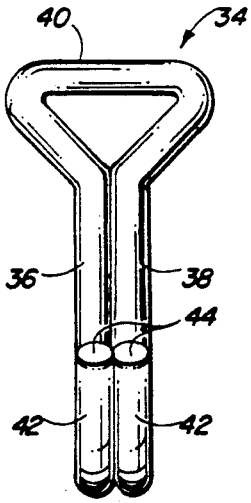
FIG. 2 (PRIOR ART)
FIGS. 2 and 3 illustrate prior art hooks which are susceptible to snagging when used in a portable shade structure of the type contemplated by the present invention.
Figure 3:
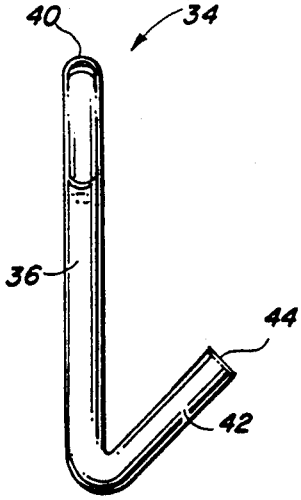
FIG. 3 (PRIOR ART)

FIGS. 2 and 3 illustrate a prior art hook 34, which has heretofore been used in the past as hook 32 in FIG. 1, in order to fasten the downwardly-extending fabric leg portion 26 to the vertical support 12. It will of course be understood that hooks of this type may be utilized anywhere along the structural support and the fabric cover in order to fasten the fabric cover to the underlying structure.

In FIGS. 2 and 3, the prior art hook 34 is typically formed of bent metal stock into a common bridging portion 40 and two legs 36, 38, each leg having a single bend or curve at the end opposite the bridging portion 40, to form a hook 42 extending back toward the bridging portion. The ends 44 thus form relatively sharp end portions which frequently snag the fabric leg portion 26, as the hooks are folded along the cover 24, 26 during storage or while being installed or removed.

Figure 4:
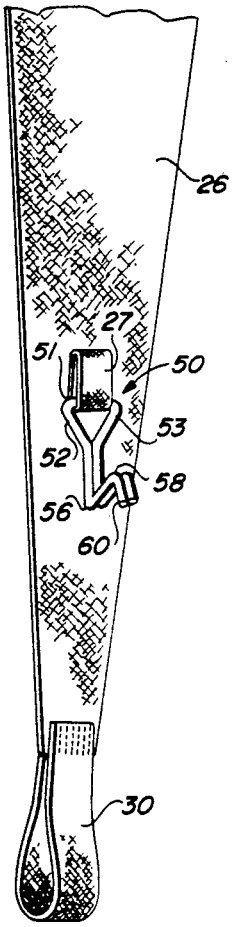
FIG. 4 illustrates a portion of the cover in the portable shade structure illustrated in FIG. 1, and further illustrates the non-snagging hook feature of the present invention.

In accordance with the present invention, there is provided a non-snagging hook, shown in FIG. 4, and identified there by the reference numeral 50. Conventionally, the non-snagging hook 50 is attached to the downward leg portion 26 of the fabric cover 24 via a fabric loop 27. To this end, the non-snagging hook 50 includes a bridging portion 51 which serves the same function as bridging portion 40 in FIGS. 2 and 3. The non-snagging hook is also formed of bent stock so as to have two legs 52, 53 which are essentially identical, and only one of which is described herein. The leg 52 includes a first shank portion 54 extending generally parallel to the fabric leg portion 26, a first return curve 56, a second return curve 58 and an outwardly extending second shank portion 60 As is shown in FIGS. 4–7, the outwardly extending second shank 60, the first and second return curves 56, 58 and the first shank 54 all lie in a common plane which is generally normal to the fabric leg portion 26, when the leg portion lies in a flat plane (of course, it will be understood that the leg portion 26 is wrapped about the vertical supports 12, 14 when installed upon the structural support.

As discussed above, the second leg 53 is essentially identical to, and extends parallel with the first leg 52.

Figure 5:
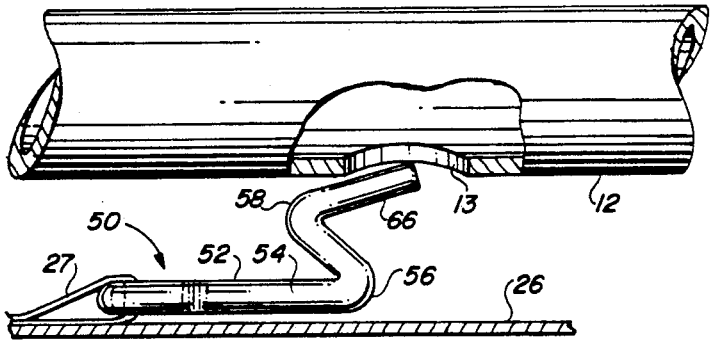
FIGS. 5–7 are side views, partially in cross section, illustrating the non-snagging hook of the present invention, and its manner of use.
Figure 6:
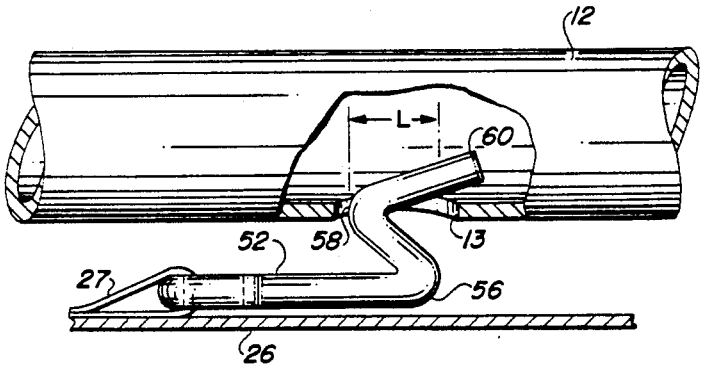
Figure 7:
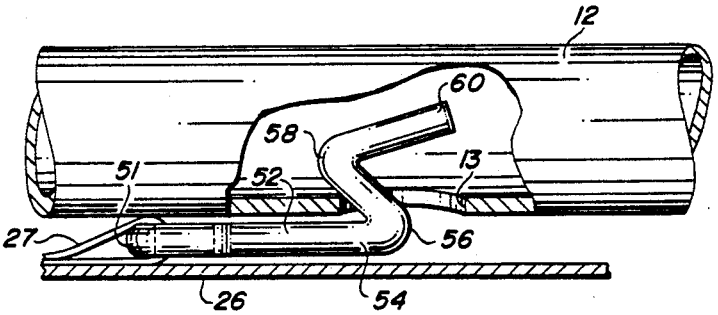

The manner in which the non-snag hook 50 is used for installation into one of the hook-receiving holes along the structural support 12 will now be described with reference to FIGS. 5–7. There, the structural support 12 is shown in side view, partially cut away, to illustrate the hook-receiving hole 13. As shown in FIG. 5, the non-snagging hook is installed by extending the second, outwardly-extending shank 60 first through the hole 13, while moving the hook 50 downwardly (i.e., to the right in FIG. 5). As shown in FIG. 6, once the first and second return curves 56, 58 are positioned immediately opposite the hole 13, then the hook 52 may be pushed directly toward the vertical support 12, and into the hole 13. As shown in FIG. 6, it will be understood that the lateral dimension L between the outer extremities of the first and second return curves 56, 58 is less than the diameter of the hook receiving hole 13. Attention is now directed to FIG. 7; once the second return curve 58 is extended into the vertical support 12, then the hook is properly engaged, with the lip of the hole !3 engaging the inside of the first return curve 56, in a conventional manner. It will be appreciated by those skilled in the art that the first and second return curves 56, 58 thus form an "S" shaped return curve so as to extend the second shank portion 60 outwardly, thereby avoiding snagging when the fabric cover and the leg portion 26 are wrapped into a compact unit, or when the leg portion 26 is being installed along the structural supports 12.

What is claimed is:

1. A portable shade structure comprising:

a structural framework including a plurality of spaced supports with hook-receiving holes along the supports;

a removable flexible cover dimensioned to fit across and be supported by the structural framework;

plural hooks attached at spaced locations to the flexible cover, each hook dimensioned to removably fit into one of the hook-receiving holes of the spaced supports;

means along each hook for preventing snagging of the hook on the flexible cover, defined by each hook having an elongated member having a first shank portion attached at one end to the flexible cover, the first shank portion lying generally parallel to the adjacent support when the hook is fitted in the corresponding hole;

the elongated member having a first return curve at the end of the shank opposite the one end and extending the elongated member in a second direction opposite to the direction of the first shank portion;

the elongated member having a second return curve adjacent the first return curve and spaced from the first shank portion, the second return curve extending the elongated member opposite from the direction between the first and second curves;

the elongated member having a second shank portion extending from the second return curve; and wherein the second shank portion extends outwardly with respect to the direction of the first shank portion; said elongated member comprises a continuous length of bent stock having two generally parallel legs, each leg having said first and second return curves.

2. The portable shade structure recited in claim 1 wherein the removable flexible cover is a knitted fabric.

3. The portable shade structure recited in claim 2 wherein the means for preventing snagging comprises a generally "S" shaped return curved portion of each hook.

4. The portable shade structure referred to in claim 3 wherein, the legs spaced apart by a common bridging portion which is generally normal to both legs.

5. The portable shade structure recited in claim 4 wherein each hook is attached to the flexible cover at the common bridging portion.

6. The portable shade structure recited in claim 3 wherein the lateral dimension across the "S" shaped return curved portion is less than the diameter of the corresponding hook-receiving hole.

7. The portable shade structure recited in claim 6 wherein the hook further comprises an outer portion beyond the "S" shaped return curved portion, the outer portion extending outwardly away from the return curved portion.

8. The portable shade structure recited in claim 7 wherein each hook comprises a first shank portion lying along, and generally parallel with the flexible cover, the "S" shaped return curved portion and the outer portion lying in a common plane with the first shank portion, the common plane being generally normal to the flexible cover.

9. A non-snagging hook for use in attaching a removable fabric shade cover to a free-standing structural framework comprising:

an elongated member having a first shank portion;

the elongated member having a first return curve at one end of the first shank portion extending the elongated member in a second direction generally opposite to the direction of the first shank portion;

the elongated member having a second return curve adjacent the first return curve and spaced from the first shank portion, the second return curve extending the elongated member in a direction generally opposite from the direction between the first and second return curve;

the elongated member having a second shank portion extending from the second return curve; and wherein the elongated member comprises a continuous length of bent stock having two generally parallel legs, each leg having the first and second shank portions and the first and second return curves, the second shank portion extending outwardly with respect to the direction of the first shank portion said legs spaced apart by a common bridging portion which is generally normal to both legs.

10. The non-snagging hook recited in claim 9 wherein portions of the structural framework have hook-receiving holes, and wherein the lateral dimension between the first and second return curves is less than the diameter of the corresponding hole which is to receive the hook.

11. The non-snagging hook recited in claim 9 wherein the first and second return curves form a generally "S" shaped configuration between the first and second shank portions.

12. The non-snagging hook recited in claim 9 wherein the first and second shank portions and the first and second return curves all lie in a common plane.

* * * * *